US006027270A

United States Patent [19]

Greive

[11] Patent Number: 6,027,270

[45] Date of Patent: Feb. 22, 2000

[54] SHEET-FED PRINTING PRESS WITH POSTPROCESSING UNIT

[75] Inventor: Martin Greive, Schönau, Germany

[73] Assignee: Heidelberger Druckmaschinen Aktiengesellschaft, Heidelberg, Germany

[21] Appl. No.: 09/217,860

[22] Filed: Dec. 21, 1998

[30] Foreign Application Priority Data

Dec. 20, 1997 [DE] Germany ..... 197 57 163

[51] Int. Cl.[7] ..... B41J 11/58

[52] U.S. Cl. ..... 400/625; 270/101; 270/21.1; 270/45; 270/58.26; 101/174; 101/232

[58] Field of Search ..... 400/625, 621; 156/277; 101/232, 483, 174, 211; 270/1.01, 1.03, 4, 12, 13, 14, 15, 17, 18, 19, 20.1, 21.1, 45, 47, 58.01, 58.23, 58.26, 58.29

[56] References Cited

U.S. PATENT DOCUMENTS

| | | | |
|---|---|---|---|
| 4,179,107 | 12/1979 | Harris | 270/4 |
| 4,519,594 | 5/1985 | Weschenfelder et al. | 270/20.1 |
| 4,824,503 | 4/1989 | Wilen | 156/277 |
| 4,966,352 | 10/1990 | NuTTIN | 101/483 |
| 5,137,506 | 8/1992 | Haenez | 270/20.1 |
| 5,308,175 | 5/1994 | Ito | 400/625 |
| 5,316,279 | 5/1994 | Corona et al. | 270/1.01 |
| 5,377,964 | 1/1995 | Haller | 270/21.1 |
| 5,730,056 | 3/1998 | Schmitt | 101/232 |

*Primary Examiner*—Eugene Eickholt
*Attorney, Agent, or Firm*—Herbert L. Lerner; Laurence A. Greenberg; Werner H. Stemer

[57] ABSTRACT

A sheet-fed printing press having a plurality of stations arranged in a row and including at least one feeder, at least one digital printing unit and at least one delivery, and a common sheet transport path, over which all sheets pass, extending between the at least one printing unit and the at least one delivery, includes a postprocessing unit for the printing press, having a plurality of postprocessing stations arranged in a row, the row of postprocessing stations being disposed parallel to and offset with respect to the row of stations of the printing press, a sheet deflector disposed on the common sheet transport path for feeding the sheets selectively to the at least one delivery and to a collecting container for receiving a batch of sheets, and a displacement device for pushing a batch of sheets, which have been collected in the collecting container, transversely to the general sheet transport direction in the printing press, into an input station of the postprocessing unit.

7 Claims, 5 Drawing Sheets

Fig.6
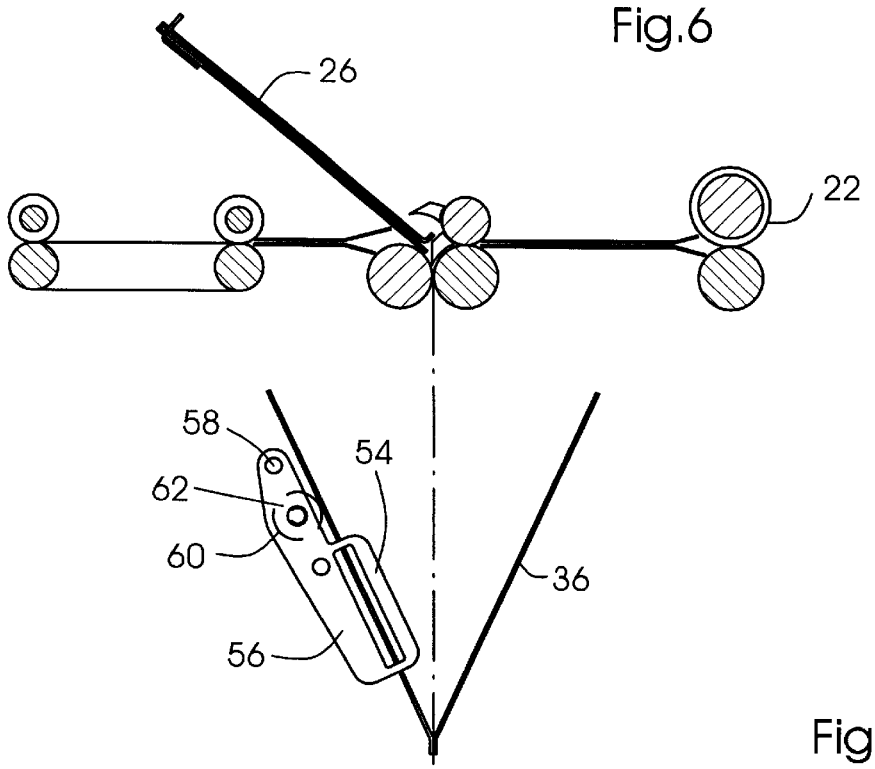
Fig.7
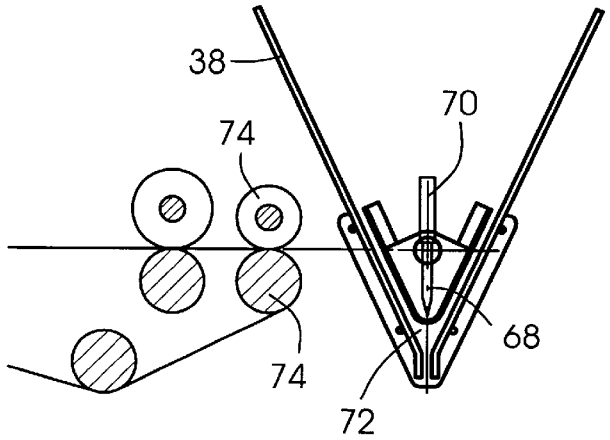
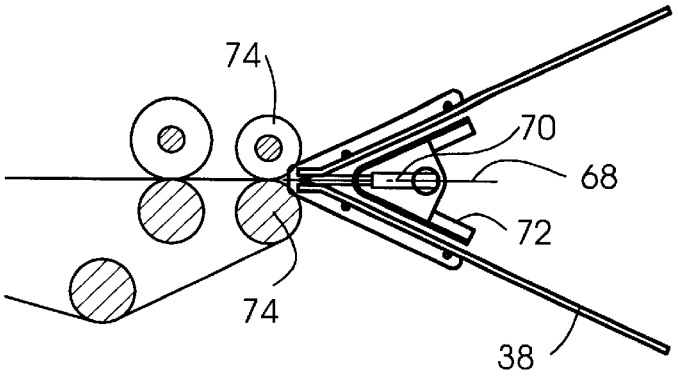
Fig.8

SHEET-FED PRINTING PRESS WITH POSTPROCESSING UNIT

BACKGROUND OF THE INVENTION

FIELD OF THE INVENTION

The invention relates to a sheet-fed printing press, more particularly, having a plurality of stations arranged in a row and including at least one feeder, at least one digital printing unit and at least one delivery, a common sheet transport path, over which all sheets pass, extending between the at least one printing unit and the at least one delivery, and a postprocessing unit for the printing press, having a plurality of postprocessing stations arranged in a row.

Digital printing units are understood to be printing units which can be activated pixel by pixel, such as laser printing units or inkjet printing units. Digital printing presses, which may contain a number of such printing units for multicolor printing, are able to print a new printed image for each new sheet, which permits the production of complete printed products, such as brochures, magazines or books, for example, at low outlay, even in the case of just a small number of copies. For this purpose, it is expedient and necessary, respectively, to be able to perform in one pass in the press all of the operations which follow the printing operation.

Postprocessing stations for collating and further processing a block of sheets to form a brochure or the like have previously, in a logical development of conventional arrangements, been connected up rectilinearly to the normal processing line, so that the sheet transport direction, essentially during the entire processing operation, runs along a line which is more or less straight but is in any case disposed in a vertical plane. A printing press that is furnished or outfitted in this manner with a postprocessing unit for brochure printing cannot readily be converted for straightforward printing and vice versa, but rather, respective complex changeover and adjustment operations are necessary. In addition, the design of the printing press and that of the postprocessing unit depend upon one another to a great extent, for which reason it is generally not possible to utilize standard components.

SUMMARY OF THE INVENTION

It is accordingly an object of the invention to provide a sheet-fed printing press with a postprocessing unit which permits the optional production of either printed and stacked individual sheets or complete printed products using one printing press, without having to perform complicated adjustment or conversion operations.

With the foregoing and other objects in view, there is provided, in accordance with the invention, a sheet-fed printing press having a plurality of stations arranged in a row and including at least one feeder, at least one digital printing unit and at least one delivery, and a common sheet transport path, over which all sheets pass, extending between the at least one printing unit and the at least one delivery, comprising a postprocessing unit for the printing press, having a plurality of postprocessing stations arranged in a row, the row of postprocessing stations being disposed parallel to and offset with respect to the row of stations of the printing press, a sheet deflector disposed on the common sheet transport path for feeding the sheets selectively to the at least one delivery and to a collecting container for receiving a batch of sheets, and a displacement device for pushing a batch of sheets, which have been collected in the collecting container, transversely to the general sheet transport direction in the printing press, into an input station of the postprocessing unit.

In accordance with another feature of the invention, the sheet deflector is formed by a folding unit so as to feed each sheet either in an unfolded state to the at least one delivery of the printing press or in a selectively folded and unfolded state, respectively, to a collecting container having a funnel-like cross section and wherein folded sheets form a batch of sheets nested inside one another.

In accordance with a further feature of the invention, the input station of the postprocessing unit contains a receiving basket having a funnel-like cross section and being aligned with the collecting container.

In accordance with an added feature of the invention, the input station of the postprocessing unit also contains a knife or blade which is movable into the interior of the funnel-like receiving basket, the receiving basket being rotatable together with the blade about an axis.

In accordance with an additional feature of the invention, the postprocessing unit also contains at least one gluer, stapler and/or edge trimmer, and a block delivery, respectively.

In accordance with yet another feature of the invention, the input station of the postprocessing unit is equipped for receiving batches of sheets, on one side, from the collecting container of the sheet-fed printing press and, on an opposite side, from a collecting container of another sheet-fed printing press.

In accordance with a concomitant feature of the invention, the sheet-fed printing press according is in combination with another sheet-fed printing press arranged parallel thereto, the postprocessing unit being disposed between the sheet-fed printing presses and being connected to both of the presses for receiving batches of sheets from both thereof.

The sheet-fed printing press may be easily derived from a standard press, because the architecture thereof is virtually unchanged by the parallel arranged postprocessing unit. The postprocessing unit can be configured in a relatively variable manner, independently of the printing press. Adjustment or conversion operations on the postprocessing unit can be performed while the press is printing normal jobs, i.e., is printing a large number of individual sheets and stacking them up loosely on a delivery pile.

In a preferred embodiment, the sheet deflector is formed by a folding unit, every sheet being fed either in an unfolded state to the at least one delivery of the printing press or selectively or optionally in a folded or unfolded state to a collecting container, which has a funnel-like cross section and wherein folded sheets form a batch of sheets nested inside one another. An output branch from the sheet deflector, which leads to the delivery of the printing press, is preferably equipped so as to permit the folding unit to be passed in a straight line, so that thick printed materials can be printed by the press without being deflected.

In this embodiment, the input station of the postprocessing unit preferably contains a receiving basket for a batch of sheets, that has a funnel-like cross section, and is aligned with the collecting container. In order to rotate a folded batch of sheets in the receiving basket into a desired direction in order to be finished off, a chopper blade is preferably introduced into the receiving basket in order to clamp the stack of sheets, and this basket is then rotated together with the blade. In addition, the blade is used to push the rotated batch of sheets between transport rollers for the purpose of onward transport.

The postprocessing unit may contain, for example, gluers, staplers and edge trimmers, in order to bind the batch of sheets to form a brochure or the like, which can subsequently be removed at a block delivery. The block delivery can be emptied from time to time without interrupting the collection of a new brochure, so that non-stop operation is possible.

The postprocessing unit may have its own housing, so that it can be separated from the printing press and, if necessary, coupled to another printing press. In a preferred embodiment, the input station of the postprocessing unit is able to receive batches of sheets both from the lefthand and from the righthand sides. Consequently, the postprocessing unit can be set up between two printing presses arranged in parallel, from which it may receive batches of sheets alternatively, and is accordingly better utilized. Correspondingly, it is expedient to design the displacement device in the printing press from the outset for optional or selective output to the lefthand and to the righthand sides, respectively.

Other features which are considered as characteristic for the invention are set forth in the appended claims.

Although the invention is illustrated and described herein as embodied in a sheet-fed printing press with a postprocessing unit, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

BRIEF DESCRIPTION OF THE DRAWINGS

FIG. 6 is a cross-sectional view of FIG. 5 taken along the line A—A in the direction of the arrows;

FIG. 7 is a cross-sectional view of FIG. 5 taken along the line B—B in the direction of the arrows; and FIG. 8 is a view like that of FIG. 7 with the take-up or receiving basket rotated clockwise through 90°.

DESCRIPTION OF THE PREFERRED EMBODIMENTS

Figure 1:
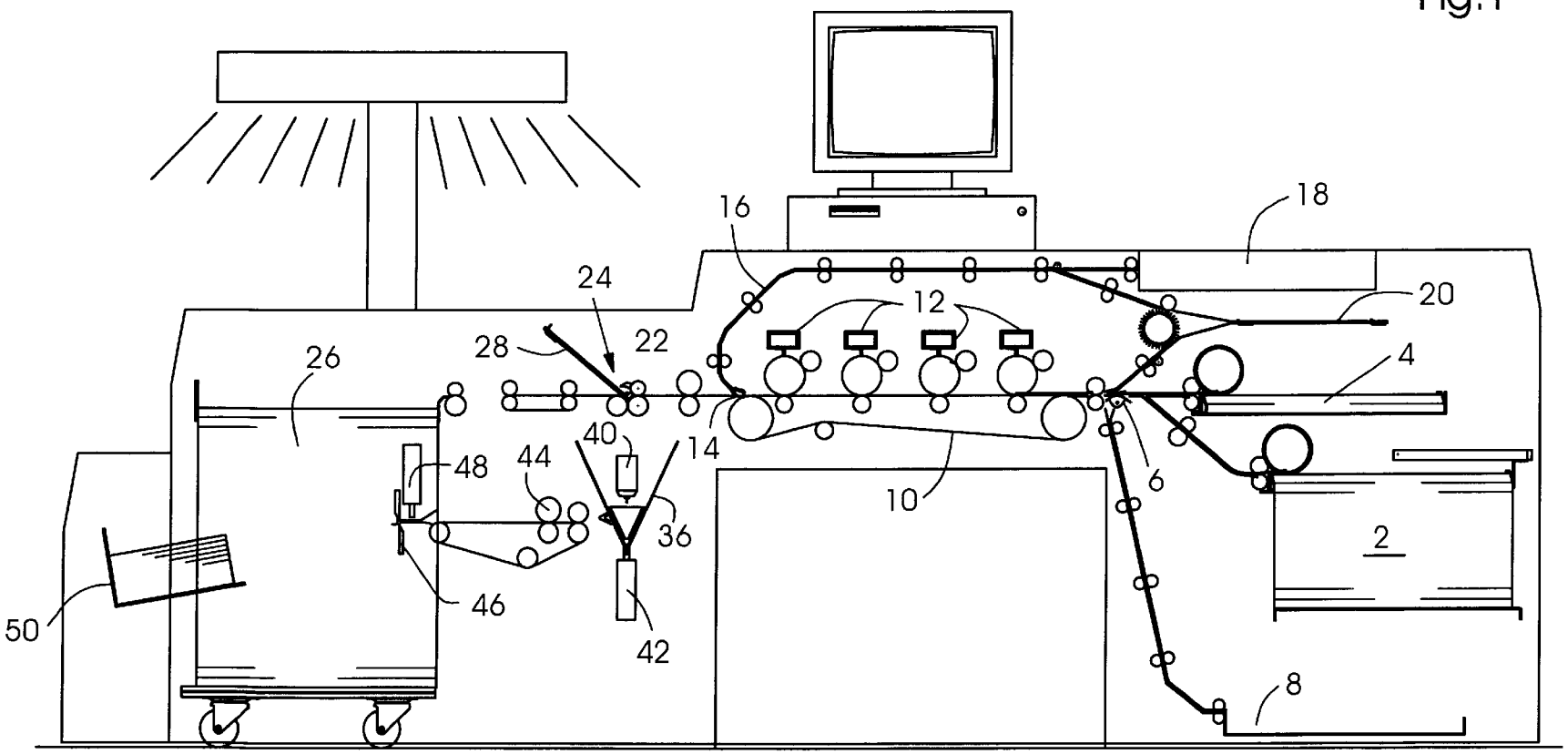
FIG. 1 is a diagrammatic side elevational view of a sheet-fed printing press, wherein some stations of a postprocessing unit arranged in parallel with the press are shown.

Referring now to the drawings and, first, particularly to FIG. 1 thereof, there is shown therein a digital sheet printing press containing two feeders, a high-pile feeder 2 and a cardboard feeder 4, on a feeder side of the press. The high-pile feeder 2 contains relatively thin papers for normal printing and for the inner pages of books, respectively, and the cardboard feeder 4 contains stiffer, thicker papers for book covers, for example. Sheet output paths of the high-pile feeder 2 and of the cardboard feeder 4 terminate jointly at a sheet deflector 6, at which defective or double-fed sheets are deflected and discharged into a defective-sheet or double-fed sheet waste or trash receptacle 8. Correctly fed-in sheets arrive on the upper side of an endless transport belt 10, where they pass a group of four printing units 12 for multicolor printing. Following a printing operation, the sheets pass a further sheet deflector 14, from which they can be led over a return transport path 16 into a sample sheet delivery 18 or into a reversing pocket 20. A sheet that is led into the reversing pocket 20 is conveyed back onto the transport belt 10 with the rear side of the sheet facing upwardly, so as to be able to print on the rear side.

The completely printed sheets travel over a common sheet transport path, on which there is arranged a perforator 22 which can be activated as required, and farther into a folding unit 24, which either allows the sheets to pass through in a straight line or deflects them in another direction, downwardly in this case, it being possible for a sheet that is deflected downwardly to be folded or not, selectively. Thus, the folding unit 24 forms a sheet deflector, which leads the sheets from the common sheet transport path onto one of two separate sheet transport paths, depending upon the print job. Sheets which are allowed to pass through in a straight line are transported onward, in order to be stacked up in a high-pile delivery 26 to form a sheet pile.

Figure 4:
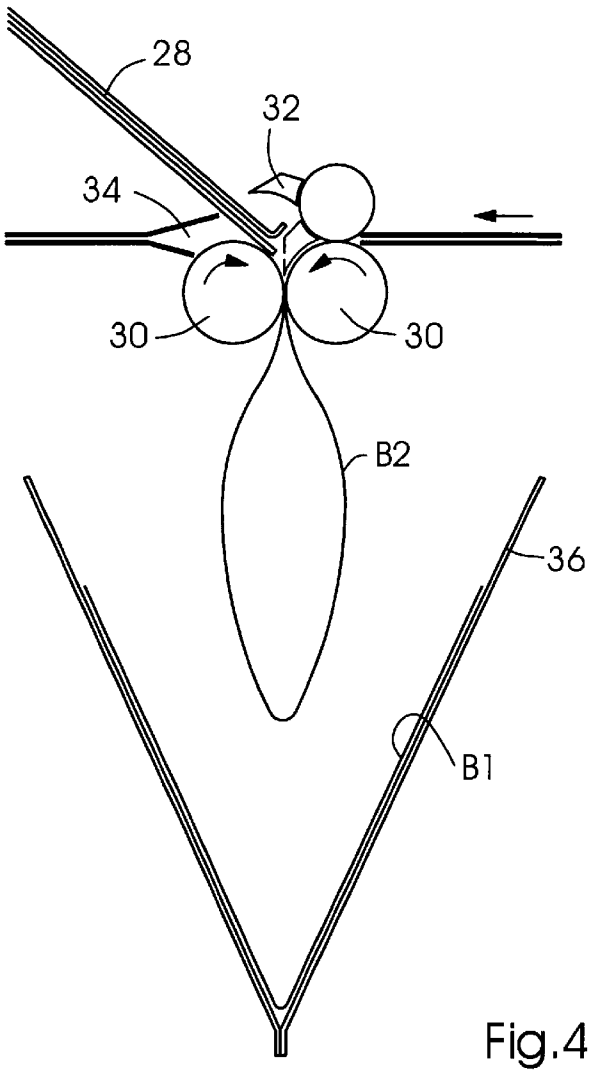
FIG. 4 is another view like that of FIG. 3 showing the folding unit and a collecting funnel in the press, the collecting funnel having received one sheet and being in the process of receiving a second sheet.
Figure 3:
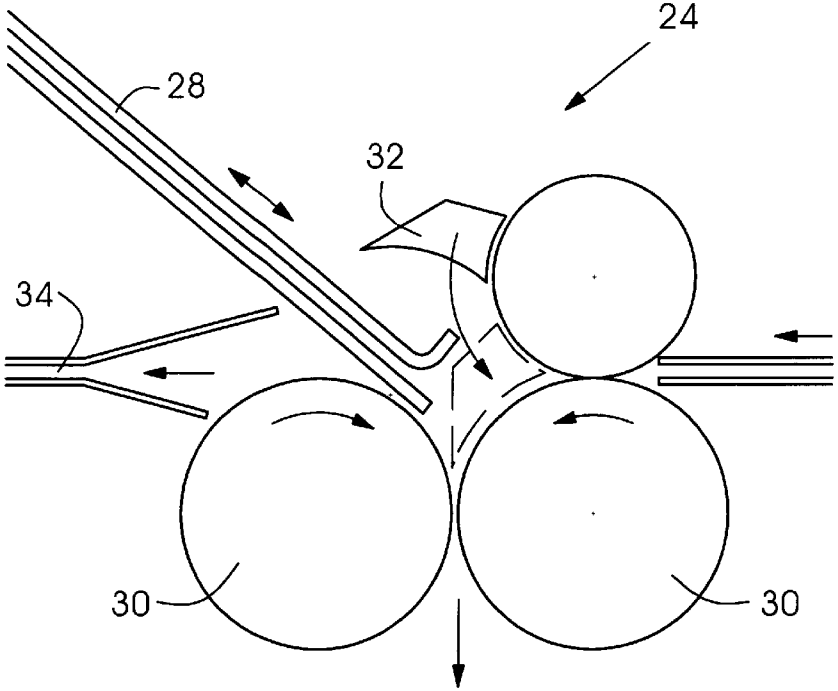
FIG. 3 is an enlarged fragmentary, diagrammatic side elevational view of FIG. 1, showing a folding unit in the printing press.

The folding unit 24 is illustrated in greater detail in FIGS. 3 and 4 and contains a folding pocket or buckle plate 28, two folding rollers 30 and a deflecting element 32. The folding unit 24 can selectively assume one of three states. In a first state, a sheet arriving from the righthand side and running up into the folding pocket 28, after striking the end of the folding pocket 28, is clamped between the folding rollers 30, which rotate in opposite directions, as indicated by the arrows associated therewith, and convey the sheet downwardly with the fold therein leading. In a second state, the deflecting element 32 is pivoted downwardly, as shown in broken lines in FIGS. 3 and 4, by which, if required, sheets can be deflected downwardly without being folded. In a third state, which is not illustrated, the folding pocket 28 is drawn or swivelled back, so that the sheets are allowed to pass through in a straight line into an outlet branch 34 to the high-pile delivery 26.

Sheets that are deflected downwardly fall of their own weight into a collecting container having a respective V-shaped and funnel-like cross section, hereinafter referred to as a collecting funnel 36. Folded sheets remain half open in the collecting funnel 36, as shown in FIG. 4, wherein a first sheet B1 is shown lying in the collecting funnel 36, while a second sheet B2 is just about to fall between the two folded sides of the first sheet B1.

After all the folded sheets belonging to a brochure have been collected, they are pushed, transversely with respect to the general sheet transport direction in the printing press, i.e., parallel to the fold thereof, into a postprocessing unit, which is disposed parallel to the normal processing line of the printing press. The displacement operation can be performed without a stop, i.e., while the next sheet is running into the folding pocket 28.

Figure 2:
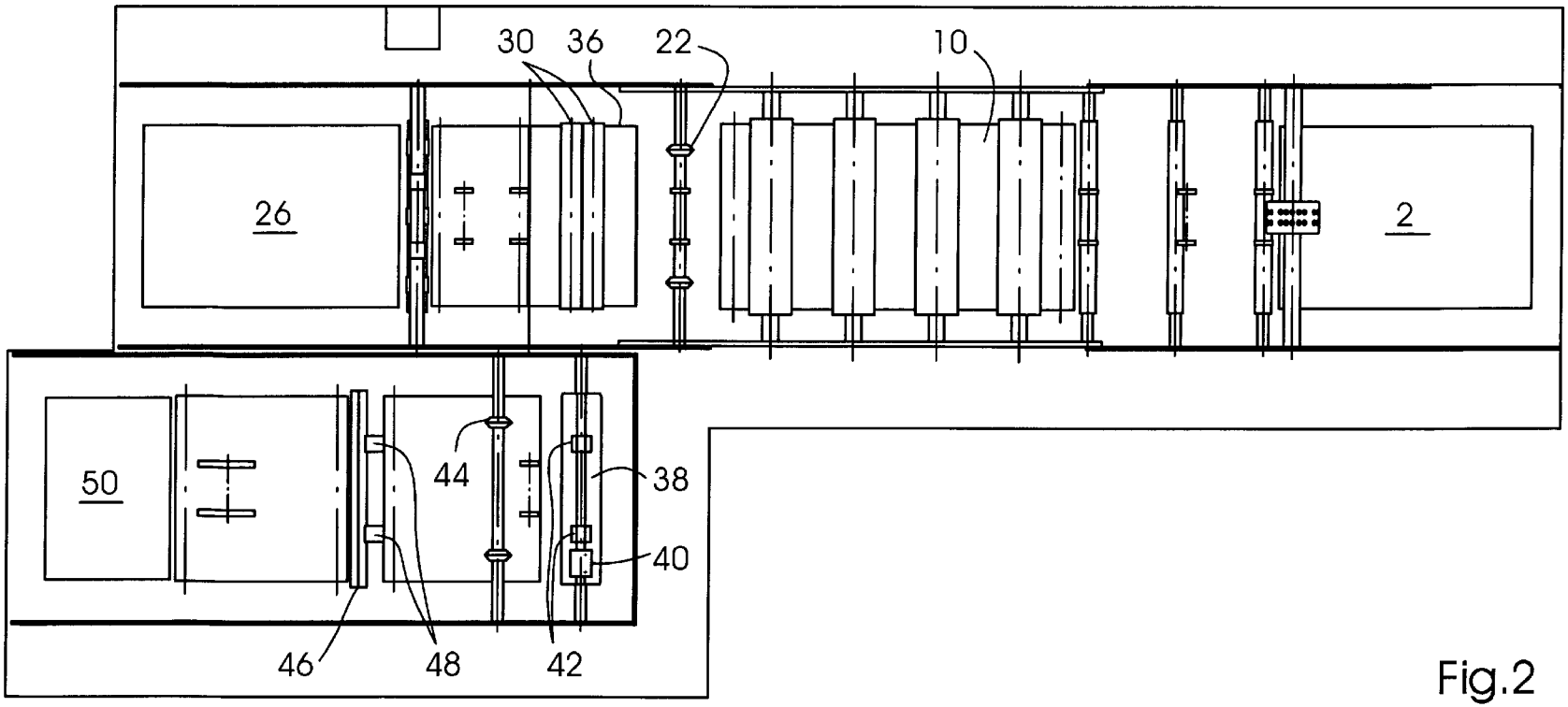
FIG. 2 is a top plan view of the arrangement of FIG. 1.

As can be seen in FIG. 1 and to best effect in the plan view of FIG. 2, the postprocessing unit contains a funnel-like receiving basket 38, on which, in addition, there are arranged a gluer 40 and two staplers 42, slitters 44 and crosscutters or sheeters 46, two block staplers 48 and a block delivery 50. This row of postprocessing stations extends at a distance from, and parallel to, the row of stations for individual sheet processing in the printing press.

Figure 5:
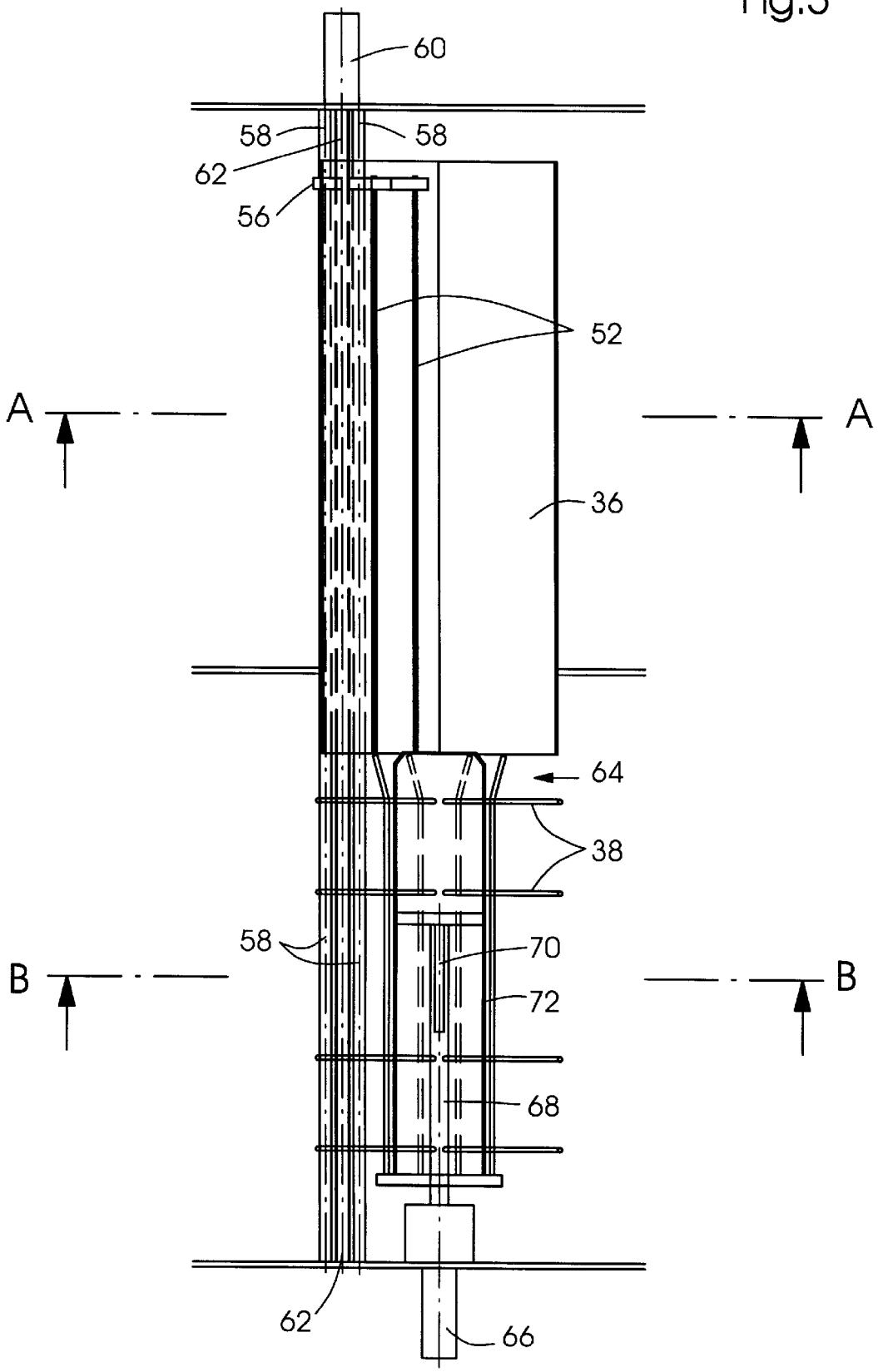
FIG. 5 is a more detailed top plan view of the collecting funnel in the printing press and a take-up or receiving basket in the postprocessing unit.

A batch of sheets that has been collated in the collecting funnel 36 of the printing press and pushed into the receiving basket 38 of the postprocessing unit is glued and stapled, and the receiving basket is then rotated through 90°. The batch of sheets, now lying horizontally, is transported by transport belts past the stations 44, 46 and 48 and, if appropriate, further stations, wherein it is finished. The finished brochures or magazines are subsequently stacked in the block delivery 50. A transfer region of the batch of sheets from the printing press to the postprocessing unit is illustrated in greater detail in FIGS. 5 to 8. FIG. 5 is an enlarged detail from the diagrammatic plan view of FIG. 2, the detail containing the collecting funnel 36 and the receiving basket 38. Formed in one of the planar limbs of the collecting funnel 36 are two elongated slits 52, through which there passes a bracket 54, which is connected to a slider 56 on the outside of the collecting funnel 36 (FIG. 6). The slider 56 can be displaced along the collecting funnel 36 along guide rods 58. A motor 60 is connected axially to a spindle 62, which extends parallel to the guide rods 58 and is coupled to the slider 56.

If the motor 60 rotates, the slider 56 is displaced parallel to the collecting funnel 36 by the spindle 62. The bracket 54 acts upon a batch of folded sheets located in the collecting funnel 36, but not illustrated in FIGS. 5 to 8, in order to push the batch as a whole into the receiving basket 38 in the postprocessing unit. The receiving basket 38 has an entry or inlet section 64 (FIG. 5) that is widened in the direction towards the collecting funnel 36, so that the batch of sheets slides easily into the receiving basket 38.

The receiving basket 38 can be rotated about a longitudinal axis 68 by a motor 66. A knife or blade 70, such as a chopper blade, can be lowered, together with the V-shaped guide 72, onto the bottom of the funnel-like receiving basket 38, i.e., into the position shown in FIG. 7, in order to clamp the batch of sheets firmly in the receiving basket 38. After the slider 56 has moved back to the collecting funnel 36, the batch of sheets is rotated through 90°, in that the entire subassembly made up of the receiving basket 38, the blade 70 and the guide 72 is rotated about the longitudinal axis 68 into the position shown in FIG. 8. Thereafter, the blade 70 drives forward through the guide 72, and through the open or opening bottom of the receiving basket 38, between transport rollers 74, entraining the batch of sheets therewith. The transport rollers 74 grip the batch of sheets arriving with their fold leading, and transport it onward, via various transport belts, to the stations 44 to 50 (FIGS. 1 and 2).

Instead of the folding unit 24, a conventional sheet deflector can also be used, it being possible, if necessary, for a folding unit to be provided in the postprocessing unit. In the event that unfolded sheets are output downwardly from the folding units 24 or the substitute sheet deflector, it is possible for a thus formed batch of sheets to be removed by hand from the collecting funnel 36. In a non-illustrated alternative embodiment, it is possible for the displacement device and the postprocessing devices to be equipped for the further processing of batches of unfolded sheets, or to be constructed so that batches of both folded and unfolded sheets can be further processed. A further possibility is to set up a postprocessing unit for batches of folded sheets and a postprocessing unit for batches of unfolded sheets to the lefthand and righthand sides of the printing press.

I claim:

1. A sheet-fed printing press having a plurality of stations arranged in a row and including at least one feeder, at least one digital printing unit and at least one delivery, and a common sheet transport path, over which all sheets pass, extending between the at least one printing unit and the at least one delivery, comprising a postprocessing unit for the printing press, having a plurality of postprocessing stations arranged in a row, said row of postprocessing stations being disposed parallel to and offset with respect to the row of stations of the printing press, a sheet deflector disposed on the common sheet transport path for feeding the sheets selectively to the at least one delivery and to a collecting container for receiving a batch of sheets, and a displacement device for pushing a batch of sheets, which have been collected in the collecting container, transversely to the general sheet transport direction in the printing press, into an input station of said postprocessing unit.

2. The sheet-fed printing press according to claim 1, wherein said sheet deflector is formed by a folding unit so as to feed each sheet either in an unfolded state to the at least one delivery of the printing press or in a selectively folded and unfolded state to a collecting container having a funnel-like cross section and wherein folded sheets form a batch of sheets nested inside one another.

3. The sheet-fed printing press according to claim 2, wherein said input station of said postprocessing unit contains a receiving basket having a funnel-like cross section and being aligned with said collecting container.

4. The sheet-fed printing press according to claim 3, wherein said input station of said postprocessing unit also contains a blade which is movable into the interior of the funnel-like receiving basket, said receiving basket being rotatable together with said blade about an axis.

5. The sheet-fed printing press according to claim 1, wherein said postprocessing unit also contains at least one gluer, stapler and/or edge trimmer, and a block delivery, respectively.

6. The sheet-fed printing press according to claim 1, wherein said input station of said postprocessing unit is equipped for receiving batches of sheets, on one side, from said collecting container of the sheet-fed printing press and, on an opposite side, from a collecting container of another sheet-fed printing press.

7. The sheet-fed printing press according to claim 6, in combination with another sheet-fed printing press arranged parallel thereto, wherein said postprocessing unit is disposed between the sheet-fed printing presses and is connected to both of the presses for receiving batches of sheets from both thereof.

* * * * *